US009677157B2

(12) United States Patent
Wang et al.

(10) Patent No.: US 9,677,157 B2
(45) Date of Patent: Jun. 13, 2017

(54) PROCESS OF PREPARING ALUMINUM ALLOY

(71) Applicants: Lisheng Wang, Qinhuangdao (CN); Zhendong Zhang, Qinhuangdao (CN); Chunhai Liu, Qinhuangdao (CN); Yongning Wang, Qinhuangdao (CN); Zhihua Zhu, Qinhuangdao (CN); Changhai Li, Qinhuangdao (CN)

(72) Inventors: Lisheng Wang, Qinhuangdao (CN); Zhendong Zhang, Qinhuangdao (CN); Chunhai Liu, Qinhuangdao (CN); Yongning Wang, Qinhuangdao (CN); Zhihua Zhu, Qinhuangdao (CN); Changhai Li, Qinhuangdao (CN)

(73) Assignee: CITIC DICASTAL Co., LTD, Qinhuangdao, Hebei Province (CN)

( * ) Notice: Subject to any disclaimer, the term of this patent is extended or adjusted under 35 U.S.C. 154(b) by 147 days.

(21) Appl. No.: 14/636,913

(22) Filed: Mar. 3, 2015

(65) Prior Publication Data

US 2015/0252450 A1 Sep. 10, 2015

(30) Foreign Application Priority Data

Mar. 5, 2014 (CN) ..... 2014 1 0077232

(51) Int. Cl.

| | |
|---|---|
| ***C22C 1/02*** | (2006.01) |
| ***C22C 21/02*** | (2006.01) |
| ***C22C 21/04*** | (2006.01) |
| ***B22D 21/00*** | (2006.01) |

(52) U.S. Cl.

CPC ..... *C22C 1/026* (2013.01); *B22D 21/007* (2013.01); *C22C 21/02* (2013.01); *C22C 21/04* (2013.01)

(58) Field of Classification Search

CPC ..... C22C 1/026; C22C 21/02; C22C 21/04

See application file for complete search history.

(56) References Cited

FOREIGN PATENT DOCUMENTS

| | | | |
|---|---|---|---|
| CN | 85100585 A | * | 7/1986 |
| CN | 101086041 A | * | 12/2007 |
| JP | 59067350 A | * | 4/1984 |

OTHER PUBLICATIONS

"Comparison Table of Cast Aluminum Alloy Grades." Comparison Table of Cast Aluminum Alloy Grades. Dandong Fuding Engineerng Machinery Co., Ltd, Sep. 26, 2014. Web. Sep. 19, 2016.*

Shikada, Yukio et al. JP 59067350 A published Apr. 17, 1984. Machine translation.*

Lihong Pan et al. CN 101086041 A published Dec. 12, 2007. Machine translation.*

Nie, Zuoren et al. "Research on Rare Earth in Aluminum." Materials Science Forum vols. 396-402 (2002) pp. 1731-1736.*

CN 85100585 A published Aug. 20, 1986 machine translation.*

* cited by examiner

*Primary Examiner* — George Wyszomierski

*Assistant Examiner* — Tima M McGuthry Banks

(74) *Attorney, Agent, or Firm* — AKC Patents LLC; Aliki K. Collins

(57) ABSTRACT

A process of preparing an aluminum alloy includes the following steps: first adding and completely melting a ZL101 Al-Si ingot and then covering the melt next adding one of modifiers Te and Sb and then performing heat preservation; finally adding one or more of rare earth elements La, Ce, Y and transition metal element Hf and then performing heat preservation. The ZL101 Al-Si alloy melt after the treatments can be casted into an ingot or a part after refining.

3 Claims, No Drawings

PROCESS OF PREPARING ALUMINUM ALLOY

TECHNICAL FIELD

The present invention relates to preparation of a metal material and particularly relates to a process of preparing a ZL101 Al—Si alloy.

BACKGROUND ART

Al—Si alloy, possessing excellent casting property and good mechanical, physical and chemical properties, is the most important series among aluminum-based cast alloys and accounts for 85%-90% of the total yield of aluminum castings. The mechanical property of the cast Al—Si alloy depends on the shape, size and distribution of primary α-Al, eutectic Si, a secondary phase intermetallic compound and pores.

Grain refinement can enhance strength and elongation rate of the aluminum alloy, improve the mechanical property, improve the feeding capacity during solidification, increase the density of the casting, reduce the casting porosity and cracks, improve the distribution of a second phase, and improve the surface smoothness of the casting and the like at the same time.

A traditional grain refinement method is adding Al—Ti—B grain refiner into the aluminum alloy. As the grain size of the cast alloy in a traditional forming mode has reached a limit, it is relatively difficult for the prior refinement method to meet the demands for the high-toughness aluminum alloy in the fields of automobiles, aviation and aerospace. Other methods for obtaining the fine grains, such as rapid solidification and spray deposition have application bottlenecks in the aspect of direct forming of complex parts by casting. Thus, it is one of main difficulties in the development of the high-performance Al—Si alloy to obtain the preparation of the high-toughness Al—Si alloy without reducing the strength.

According to document retrieval, it is found that, by grain refinement, the elongation rate of the ZL101 alloy can be improved from original 3.9% to 6.5% in Zhang Yijie, et al., Influence of Al—Ti—B nano-grain refiner on mechanical and damping properties of ZL101 alloy, Rare Metal Materials and Engineering, 2006, 35(3): 476-479. Although the elongation rate of the Al—Si alloy can be effectively improved through the method, the demands for high toughness (having the elongation rate of more than 12%) in the fields of automobiles, aviation and aerospace are still very difficult to meet.

INVENTION CONTENTS

The application provides a preparation technology of a high-toughness ZL101 Al—Si alloy against the shortcoming of relatively low elongation rate of the Al—Si alloy in the prior protection technology. The present invention realizes controllable morphology of α-Al and eutectic Si in a solidification process through a crystal growth control technology.

The technical solution adopted by the present invention is as follows:

(1) adding a ZL101 Al—Si alloy and covering the melt after complete melting said alloy;

(2) adding one of modifiers Te and Sb and then performing heat preservation; and (3) adding one or more of rare earth elements La, Ce, Y and Hf and then performing heat preservation;

The ZL101 Al—Si alloy melt after the treatment can be casted into an ingot or a part after refining, and a high-toughness ZL101 Al—Si alloy can be obtained after cooling.

In step (2), the adding temperature of Te and Sb is in the range of 680° C.-740° C., the total adding amount is 0.1-0.5% of the mass of the melt of the Al—Si alloy, and the heat preservation time is 15-60 min.

In step (3), the adding temperature of La, Ce, Y and Hf is in the range of 700° C.-730° C., the total adding amount is 0.1-1% of the mass of the melt of the Al—Si alloy, and the heat preservation time is 5-15 min.

Compared with the existing processes, by adopting the combined effect of the rare earth elements and the long-acting modifiers, the present invention realizes the controllable morphology of α-Al and eutectic Si, and inhibits the formation of α-Al dendrites and the generation of the long strip shape eutectic Si in the solidification process, thus the high-toughness ZL101 Al—Si alloy is prepared.

DETAILED DESCRIPTION

The following embodiments are provided in conjunction with the contents of the present invention to further understand the present invention.

EXAMPLE 1

Place 10 Kg of a ZL101 Al—Si alloy into a crucible for melting, add Te accounting for 0.1% of the mass of a melt of the Al—Si alloy when the temperature reaches 680° C. and perform heat preservation for 15 min. Add La accounting for 0.1% of the mass of the melt of the aluminum alloy when the temperature of the melt reaches 700° C., perform heat preservation for 5 min, refine the melt, and then pour the melt into a mold to obtain a ZL101 Al—Si alloy with good mechanical property, wherein α-Al is oval and eutectic silicon has a shape of short rod. A tensile test is performed on an alloy test bar after T6 treatment, which indicates that the elongation rate is 12% and the tensile strength is 300 Mpa.

EXAMPLE 2

Place 10 Kg of a ZL101 Al—Si alloy into a crucible for melting, add Sb accounting for 0.5% of the mass of a melt of the Al—Si alloy when the temperature reaches 740° C., and perform heat preservation for 60 min. Add La, Ce, Y and Hf accounting for 0.3%, 0.3%, 0.2% and 0.2% respectively of the mass of the melt of the Al—Si melt when the temperature of the melt reaches 730° C., perform heat preservation for 15 min, refine the melt, and then pour the melt into a mold to obtain a ZL101 Al—Si alloy with good mechanical property, wherein α-Al is spherical and eutectic silicon is nearly spherical. A tensile test is performed on an alloy test bar after T6 treatment, which indicates that the elongation rate is 18% and the tensile strength is 290 Mpa.

EXAMPLE 3

Place 10 Kg of a ZL101 Al—Si alloy into a crucible for melting, add Te and Sb accounting for 0.2% and 0.1% respectively of the mass of the melt of the Al—Si alloy when the temperature reaches 710° C., and perform heat preservation for 40 min. Add La and Y accounting for 0.2% and 0.3% respectively of the mass of the melt of the Al—Si alloy when the temperature of the melt reaches 715° C., perform heat preservation for 10 min, refine the melt, and then pour the melt into a mold to obtain a ZL101 Al—Si alloy with good mechanical property, wherein α-Al is oval and eutectic silicon has a shape of a short rod. A tensile test is performed on an alloy test bar after T6 treatment, which indicates that the elongation rate is 16% and the tensile strength is 295 Mpa.

The above description is only used for explaining the present invention rather than limiting the present invention. The scope limited by the present invention is defined by claims and various modifications can be made within the protection scope of the present invention.

The invention claimed is:

1. A process of preparing an aluminum alloy comprising:

melting a ZL101 Al-Si alloy, and after the ZL101 Al-Si alloy is completely melted covering the melt, wherein the melting of the ZL101 Al-Si alloy comprises placing 10 Kg of the ZL101 Al-Si alloy into a crucible for melting;

adding a modifier Te accounting for 0.1% of the mass of the melt of the ZL101 Al-Si alloy when the temperature of the melt reaches 680° C., and performing heat preservation for 15 minutes;

adding a rare earth element La accounting for 0.1% of the mass of the melt of the ZL101 Al Si alloy when the temperature of the melt reaches 700° C., and then performing heat preservation for 5 minutes; and refining the melt and then pouring the melt into a mold.

2. A process of preparing an aluminum alloy comprising:

melting a ZL101 Al-Si alloy, and after the ZL101 Al-Si alloy is completely melted covering the melt, wherein the melting of the ZL101 Al-Si alloy comprises placing 10Kg of the ZL101 Al-Si alloy into a crucible for melting;

adding a modifier Sb accounting for 0.5% of the mass of the melt of the ZL101 Al-Si alloy when the temperature of the melt reaches 740° C., and performing heat preservation for 60 minutes;

adding rare earth elements La, Ce, Y and transition metal element Hf accounting for 0.3%, 0.3%, 0.2% and 0.2% respectively of the mass of the melt of the ZL101 Al-Si alloy when the temperature of the melt reaches 730° C., and performing heat preservation for 15 minutes; and refining the melt and then pouring the melt into a mold.

3. A process of preparing an aluminum alloy comprising:

melting a ZL101 Al-Si alloy, and after the ZL101 Al-Si alloy is completely melted covering the melt, wherein the melting of the ZL101 Al-Si alloy comprises placing 10Kg of the ZL101 Al-Si alloy into a crucible for melting;

adding modifiers Te and Sb accounting for 0.2% and 0.1% respectively of the mass of the melt of the ZL101 Al-Si alloy when the temperature of the melt reaches 710° C., and performing heat preservation for 40 minutes;

adding rare earth elements La and Y accounting for 0.2% and 0.3% respectively of the mass of the melt of the ZL101 Al-Si alloy when the temperature of the melt reaches 715° C., and performing heat preservation for 10 minutes; and refining the melt and then pouring the melt into a mold.

* * * * *